US007816846B2

(12) United States Patent
Takada et al.

(10) Patent No.: US 7,816,846 B2
(45) Date of Patent: Oct. 19, 2010

(54) SPARK PLUG WITH SLANT PERIPHERAL SURFACE

(75) Inventors: Kenichiro Takada, Kuwana (JP); Ken Hanashi, Handa (JP); Takayuki Takeuchi, Aichi-ken (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 371 days.

(21) Appl. No.: 11/976,438

(22) Filed: Oct. 24, 2007

(65) Prior Publication Data

US 2008/0093965 A1 Apr. 24, 2008

(30) Foreign Application Priority Data

Oct. 24, 2006 (JP) ..... 2006-288239

(51) Int. Cl.
*H01T 13/20* (2006.01)

(52) U.S. Cl. ..... 313/143; 313/141

(58) Field of Classification Search ..... 313/143, 313/141, 139, 142, 144, 145, 124
See application file for complete search history.

(56) References Cited

U.S. PATENT DOCUMENTS 2,353,620 A * 7/1944 Weinerth ..... 174/152 S
3,577,170 A * 5/1971 Nylen ..... 313/123
3,825,784 A * 7/1974 Lindsay ..... 313/11.5
3,870,918 A * 3/1975 Senda et al. ..... 313/131 R
4,211,952 A * 7/1980 Iwata et al. ..... 313/143
5,144,188 A * 9/1992 Kagawa et al. ..... 313/11.5
5,239,225 A * 8/1993 Moriya et al. ..... 313/141
5,767,613 A * 6/1998 Kunt ..... 313/141
5,799,637 A 9/1998 Cifuni
5,998,912 A * 12/1999 Schwab ..... 313/118
6,078,129 A 6/2000 Gotou et al.
6,094,000 A 7/2000 Osamura et al.
6,262,522 B1 * 7/2001 Osamura et al. ..... 313/141

(Continued)

FOREIGN PATENT DOCUMENTS

EP 0 758 152 2/1997

(Continued)

OTHER PUBLICATIONS

U.S. Appl. No. 11/877,913, filed Oct. 2007, Takeuchi et al.

(Continued)

*Primary Examiner*—Nimeshkumar D Patel
*Assistant Examiner*—Glenn Zimmerman
(74) *Attorney, Agent, or Firm*—Nixon & Vanderhye PC

(57) ABSTRACT

A spark plug for an internal combustion engine is provided which includes a hollow cylindrical metal shell with an open end portion to be exposed to a combustion chamber of the engine, a ground electrode joined to the metal shell, a center electrode disposed in the metal housing to define a spark gap between itself and the ground electrode. The spark plug also includes a stream shaper or a stream reflector geometrically formed on the metal shell and/or the porcelain insulator to shape a vortex steam of air-fuel mixture into a stream thereof which is oriented outside the spark plug or serves to decrease the amount of the air-fuel mixture into a pocket between the metal shell and the porcelain insulator. This ensures the stability of ignition of the air-fuel mixture.

4 Claims, 14 Drawing Sheets

U.S. PATENT DOCUMENTS

| | | | | |
|---|---|---|---|---|
| 6,580,202 | B1 * | 6/2003 | Pollner | 313/145 |
| 6,628,050 | B1 * | 9/2003 | Kameda et al. | 313/143 |
| 6,642,638 | B2 * | 11/2003 | Ishiguro | 313/141 |
| 6,846,214 | B1 | 1/2005 | Gotou et al. | |
| 6,853,116 | B2 * | 2/2005 | Hori et al. | 313/141 |
| 7,007,653 | B2 | 3/2006 | Labarge et al. | |
| 7,057,332 | B2 * | 6/2006 | Burrows | 313/141 |
| 7,262,547 | B2 * | 8/2007 | Klett et al. | 313/143 |
| 2003/0001474 | A1 | 1/2003 | Teramaura et al. | |
| 2005/0062386 | A1 * | 3/2005 | Francesconi et al. | 313/143 |
| 2005/0264152 | A1 * | 12/2005 | Kanao | 313/141 |
| 2007/0052336 | A1 | 3/2007 | Liao | |
| 2007/0126330 | A1 * | 6/2007 | Kuki et al. | 313/143 |
| 2008/0092838 | A1 | 4/2008 | Takeuchi et al. | |
| 2008/0092839 | A1 | 4/2008 | Hanashi et al. | |

FOREIGN PATENT DOCUMENTS

| | | |
|---|---|---|
| JP | 4-4583 | 1/1992 |
| JP | 9-007733 | 1/1997 |
| JP | 09-106881 | 4/1997 |
| JP | H11-003765 | 1/1999 |
| JP | 2002-260816 | 9/2002 |
| JP | 2005-63705 | 3/2005 |
| WO | WO 2005060060 A1 * | 6/2005 |

OTHER PUBLICATIONS

U.S. Appl. No. 11/923,066, filed Oct. 2007, Hanashi et al.
Official Action dated Oct. 23, 2009, issued in copending U.S. Appl. No. 11/923,066, of Hanashi et al, filed Oct. 24, 2007.
Information Offer Form submitted Jun. 10, 2010, in corresponding JP Application No. 2006-288239, with English translation.

* cited by examiner

SPARK PLUG WITH SLANT PERIPHERAL SURFACE

CROSS REFERENCE TO RELATED DOCUMENT

The present application claims the benefit of Japanese Patent Application No. 2006-288239 filed on Oct. 24, 2006, the disclosure of which is incorporated herein by reference.

This application is also related to copending, commonly assigned and filed U.S. application Ser. Nos. 11/877,913 and 11/923,066.

BACKGROUND OF THE INVENTION

1. Technical Field of the Invention

The present invention relates generally to a spark plug for internal combustion engines which may be employed in automotive vehicles, cogeneration systems, or gas feed pumps, and more particularly to an improved structure of such a spark plug designed to shape or orient a vortex stream of air-fuel mixture, thereby ensuring the stability of ignition of air-fuel mixture in a combustion chamber of the engine.

2. Background Art

Japanese Patent First Publication No. 11-3765 (U.S. Pat. No. 6,846,214 B1) discloses a typical spark plug for internal combustion engines which includes a metal shell with an external mounting thread, a porcelain insulator retained in the metal shell, a center electrode retained inside the porcelain insulator, and a ground electrode welded to the metal shell to define a spark gap between itself and the top of the center electrode.

The above type of spark plug works to produce a sequence of sparks within the spark gap to ignite an air-fuel mixture, thereby creating flame which will grow to induce the detonation of the mixture.

Usually, after entering a combustion chamber of the internal combustion engine, the air-fuel mixture creates a vortex stream which may flow into a pocket defined between the metal shell and the porcelain insulator of the spark plug, which forces an initial flame, as produced around the spark gap, into the pocket so that it is extinguished. This results in a failure in burning the air-fuel mixture completely.

Especially, direct-injection engines are so designed as to charge an air-fuel mixture into the combustion chamber at a high velocity in order to stir the air and fuel and, thus, have a greater concern about the facilitation of extinguishing of the flame of the air-fuel mixture.

SUMMARY OF THE INVENTION

It is therefore a principal object of the invention to avoid the disadvantages of the prior art.

It is another object of the invention to provide a spark plug for internal combustion engines which is designed to enhance the stability of ignition of air-fuel mixture.

According to one aspect of the invention, there is provided a spark plug for an internal combustion engine which may be employed in automotive vehicles, cogeneration systems, or gas feed pumps. The spark plug comprises: (a) a hollow cylindrical metal shell with an open top end, the metal shell having an annular inner shoulder formed on an inner peripheral wall thereof; (b) a porcelain insulator having a length, the porcelain insulator including a first outer shoulder formed on an outer peripheral wall thereof, the porcelain insulator being positioned within the metal shell in abutment of the first outer shoulder with the inner shoulder of the metal shell; (c) a center electrode disposed in the porcelain insulator; (d) a ground electrode joined to the metal shell to define a spark gap between itself and a top end of the center electrode; and (e) a second outer shoulder formed on a portion of the outer peripheral wall of the porcelain insulator which is located between a top end of the porcelain insulator and the first outer shoulder of the porcelain insulator. The second outer shoulder is closer to the first outer shoulder than the open top end of the metal shell in a lengthwise direction of the porcelain insulator. The second outer shoulder tapers toward the top end of the porcelain insulator.

In use of the spark plug in the internal combustion engine, an air-fuel mixture having entered a combustion chamber may create a vortex stream flowing into a pocket between the metal shell and the porcelain insulator of the spark plug. The second outer shoulder works as a stream reflector to reflect or orient a stream of the air-fuel mixture having hit thereon outside the pocket, thereby decreasing the amount of the air-fuel mixture entering the pocket and minimizing the possibility that the flame, as produced near the spark gap, will be carried by the stream of the air-fuel mixture into the pocket so that it is extinguished, thus ensuring the ability of the spark plug to ignite the mixture.

In the preferred mode of the invention, the metal shell may have a slant peripheral surface formed on the open top end thereof. The slant peripheral surface faces inwardly of the metal shell so as to define an inner diameter of the metal shell increasing outward in an axial direction of the metal shell.

The porcelain insulator may have a slant peripheral surface formed on the top end thereof. The slant peripheral surface faces inwardly of the porcelain insulator so as to define an inner diameter of the porcelain insulator increasing outward in an axial direction of the porcelain insulator.

The ground electrode includes an upright portion extending from the metal shell toward a top end of the spark plug in an axial direction of the spark plug. The upright portion may have a narrow width section which facilitate the ease of flow of the air-fuel mixture through the upright portion of the ground electrode.

The ground electrode may include a portion with a chamfered corner which faces the top end of the center electrode, thereby enhancing the shaping of a flow of the air-fuel mixture having come near the top of the spark plug in a diagonally downward direction of the spark plug.

According to the second aspect of the invention, there is provided a spark plug for an internal combustion engine which comprises: (a) a hollow cylindrical metal shell with an open top end, the metal shell having an annular inner shoulder formed on an inner peripheral wall thereof; (b) a porcelain insulator having a length, the porcelain insulator including a first outer shoulder formed on an outer peripheral wall thereof, the porcelain insulator being positioned within the metal shell in abutment of the first outer shoulder with the inner shoulder of the metal shell; (c) a center electrode disposed in the porcelain insulator; (d) a ground electrode joined to the metal shell to define a spark gap between itself and a top end of the center electrode; and (e) a slant peripheral surface formed on the top end of the porcelain insulator. The slant peripheral surface faces inwardly of the porcelain insulator so as to define an inner diameter of the porcelain insulator increasing outward in an axial direction of the porcelain insulator.

The slant peripheral surface works as a stream shaper to shape a vortex stream of the air-fuel mixture flowing toward the top of the porcelain insulator into a stream of the air-fuel mixture along the slant peripheral surface which flows away from the top of the porcelain insulator (i.e., deep inside a combustion chamber of the engine). This minimizes the possibility that the flame, as produced near the spark gap, will be carried by the stream of the air-fuel mixture into a pocket between the metal shell and the porcelain insulator so that it is extinguished, thus ensuring the ability of the spark plug to ignite the mixture.

In the preferred mode of the invention, the ground electrode may include a portion with a chamfered corner which faces the top end of the center electrode, thereby enhancing the shaping of a flow of the air-fuel mixture having come near the top of the spark plug in a diagonally downward direction of the spark plug.

According to the third aspect of the invention, there is provided a spark plug for an internal combustion engine which comprises: (a) a hollow cylindrical metal shell with an open top end, the metal shell having an annular inner shoulder formed on an inner peripheral wall thereof; (b) a porcelain insulator having a length, the porcelain insulator including a first outer shoulder formed on an outer peripheral wall thereof, the porcelain insulator being positioned within the metal shell in abutment of the first outer shoulder with the inner shoulder of the metal shell; (c) a center electrode disposed in the porcelain insulator; (d) a ground electrode joined to the metal shell to define a spark gap between itself and a top end of the center electrode; and (e) a recess formed on a portion of the outer peripheral wall of the porcelain insulator which faces an area of the inner peripheral wall of the metal shell near the open top end.

The recess of the porcelain insulator works a stream shaper to shape a flow of the air-fuel mixture entering a pocket defined between the porcelain insulator and the metal shell into a vortex stream of the air-fuel mixture within an entrance of the pocket, thereby decreasing the amount of the air-fuel mixture flowing inside the pocket. This minimizes the extinguishing of a flame of the air-fuel mixture.

In the preferred mode of the invention, the porcelain insulator may have a slant peripheral surface formed on the top end thereof. The slant peripheral surface faces inwardly of the porcelain insulator so as to define an inner diameter of the porcelain insulator increasing outward in an axial direction of the porcelain insulator.

The ground electrode may include a portion with a chamfered corner which faces the top end of the center electrode.

The metal shell has a recess formed in an area of the inner peripheral wall which faces the recess formed in the porcelain insulator in a direction substantially perpendicular to the length of the porcelain insulator. The recess defines a chamber between the metal shell and the porcelain insulator along with the recess of the porcelain insulator to facilitate the formation of the vortex stream of the air-fuel mixture within the entrance of the pocket.

According to the fourth aspect of the invention, there is provided a spark plug for an internal combustion engine which comprises: (a) a hollow cylindrical metal shell with an open top end, the metal shell having an annular inner shoulder formed on an inner peripheral wall thereof; (b) a porcelain insulator having a length, the porcelain insulator including a first outer shoulder formed on an outer peripheral wall thereof, the porcelain insulator being positioned within the metal shell in abutment of the first outer shoulder with the inner shoulder of the metal shell; (c) a center electrode disposed in the porcelain insulator; (d) a ground electrode including an upright portion extending from the metal shell toward a top end of the spark plug in an axial direction of the spark plug, the ground electrode defining a spark gap between itself and a top end of the center electrode; and (e) a narrow width section provided in the upright portion of the ground electrode.

The narrow width section defines a flow path which facilitates the passage of the air-fuel mixture flowing through the upright portion of the ground electrode. Specifically, the narrow width section serves to minimize the disturbance of the stream of the air-fuel mixture which has flowed around the top of the porcelain insulator and is going to pass the upright portion of the ground electrode, thereby facilitating the ease of formation of streams of the air-fuel mixture oriented perpendicular to the axis of the spark plug near the top end of the metal shell to minimize the amount of the air-fuel mixture flowing into a pocket between the metal shell and the porcelain insulator. This minimizes the possibility that the flame, as produced near the spark gap, will be carried by the vortex stream of the air-fuel mixture into the pocket so that it is extinguished, thus ensuring the ability of the spark plug to ignite the mixture.

In the preferred mode of the invention, the narrow width section defines the flow path extending from an outer surface to an inner surface of the upright portion. The flow path is so shaped that a transverse section at the inner surface is smaller than that at the outer surface, thereby accelerating the flow of the air-fuel mixture passing through the flow path.

The porcelain insulator may have a recess formed on a portion of the outer peripheral wall which faces an area of the inner peripheral wall of the metal shell near the open top end.

The porcelain insulator has a slant peripheral surface formed on the top end thereof. The slant peripheral surface faces inwardly of the porcelain insulator so as to define an inner diameter of the porcelain insulator increasing outward in an axial direction of the porcelain insulator.

The ground electrode may include a portion with a chamfered corner which faces the top end of the center electrode.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
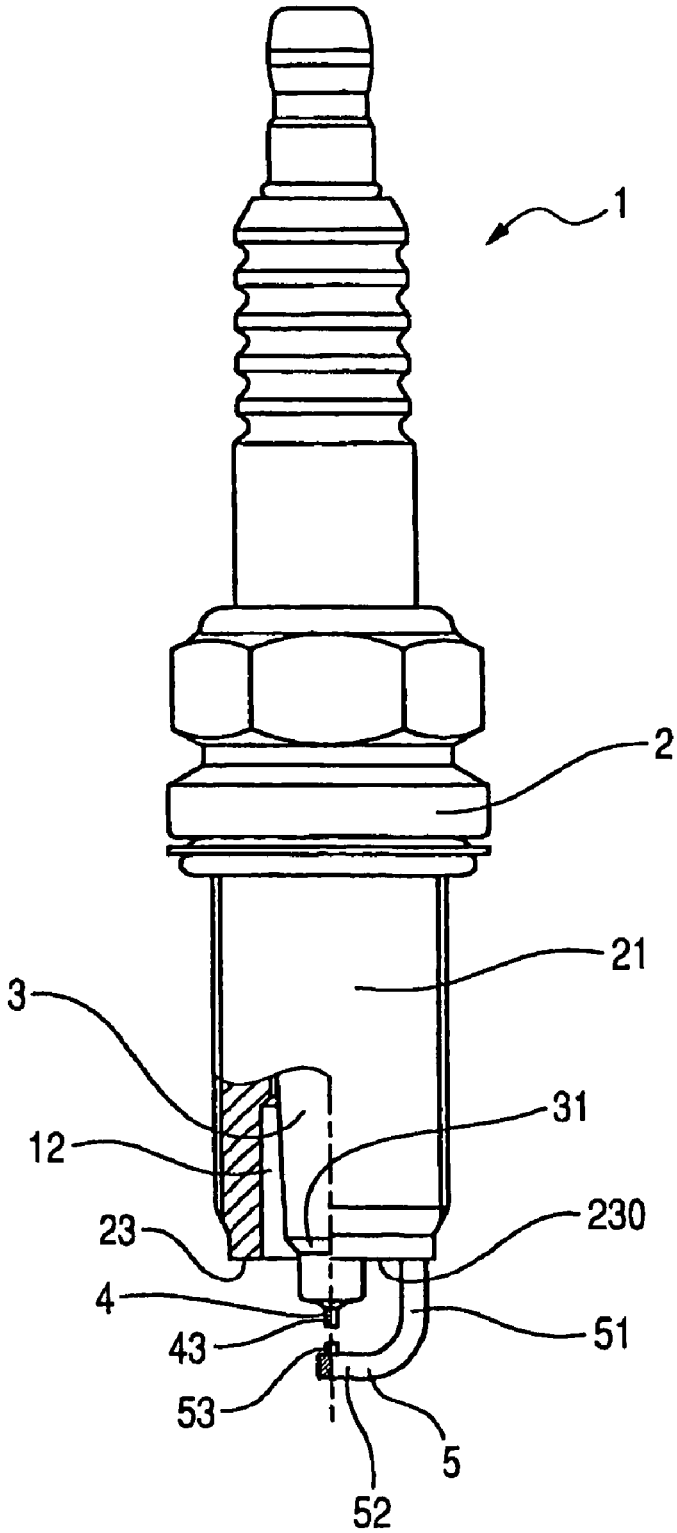
FIG. 1 is a partially sectional view which illustrates a spark plug according to the first embodiment of the invention.
Figure 2:
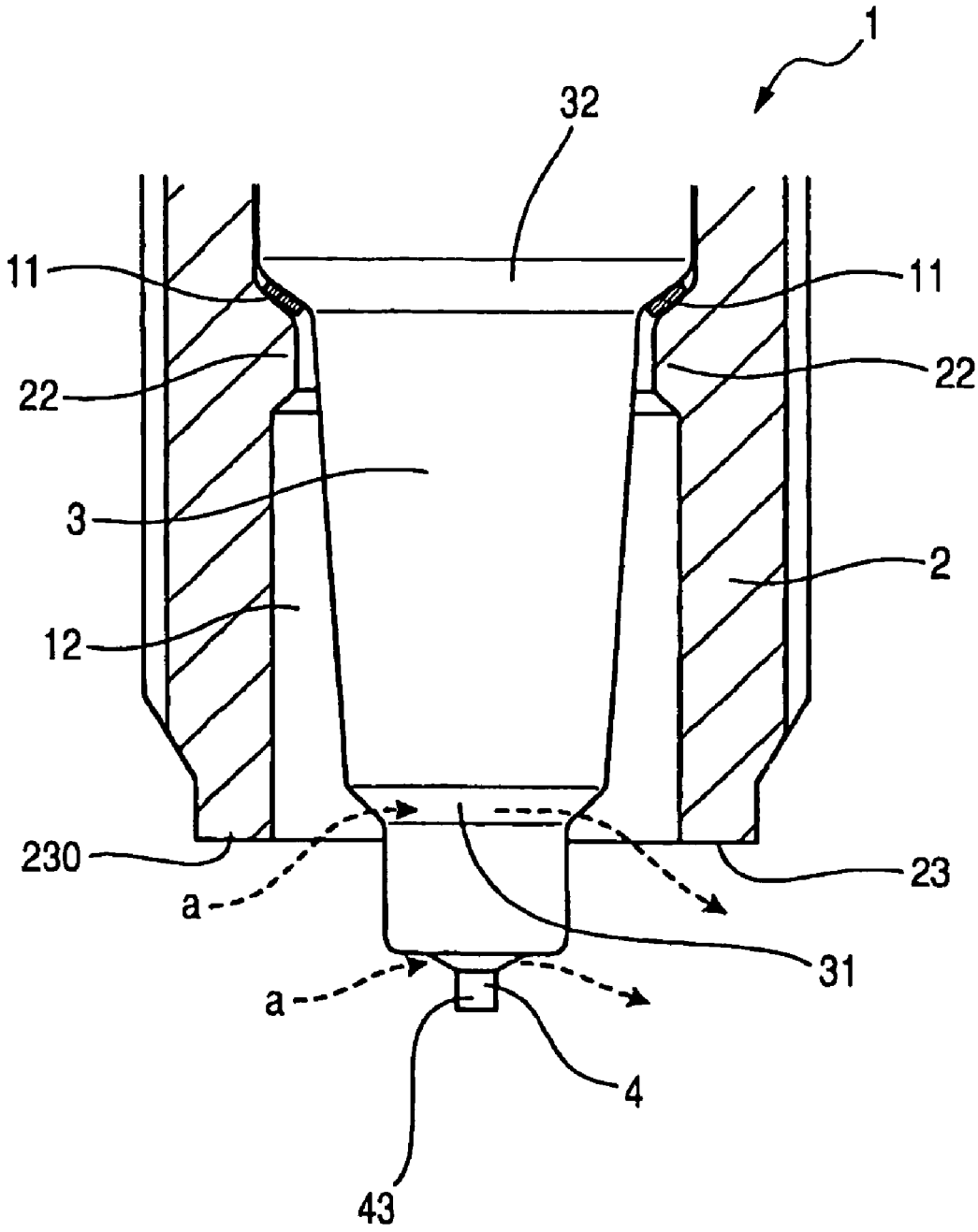
FIG. 2 is a partially enlarged longitudinal sectional view which illustrates a top end portion of the spark plug of FIG. 1.
Figure 3:
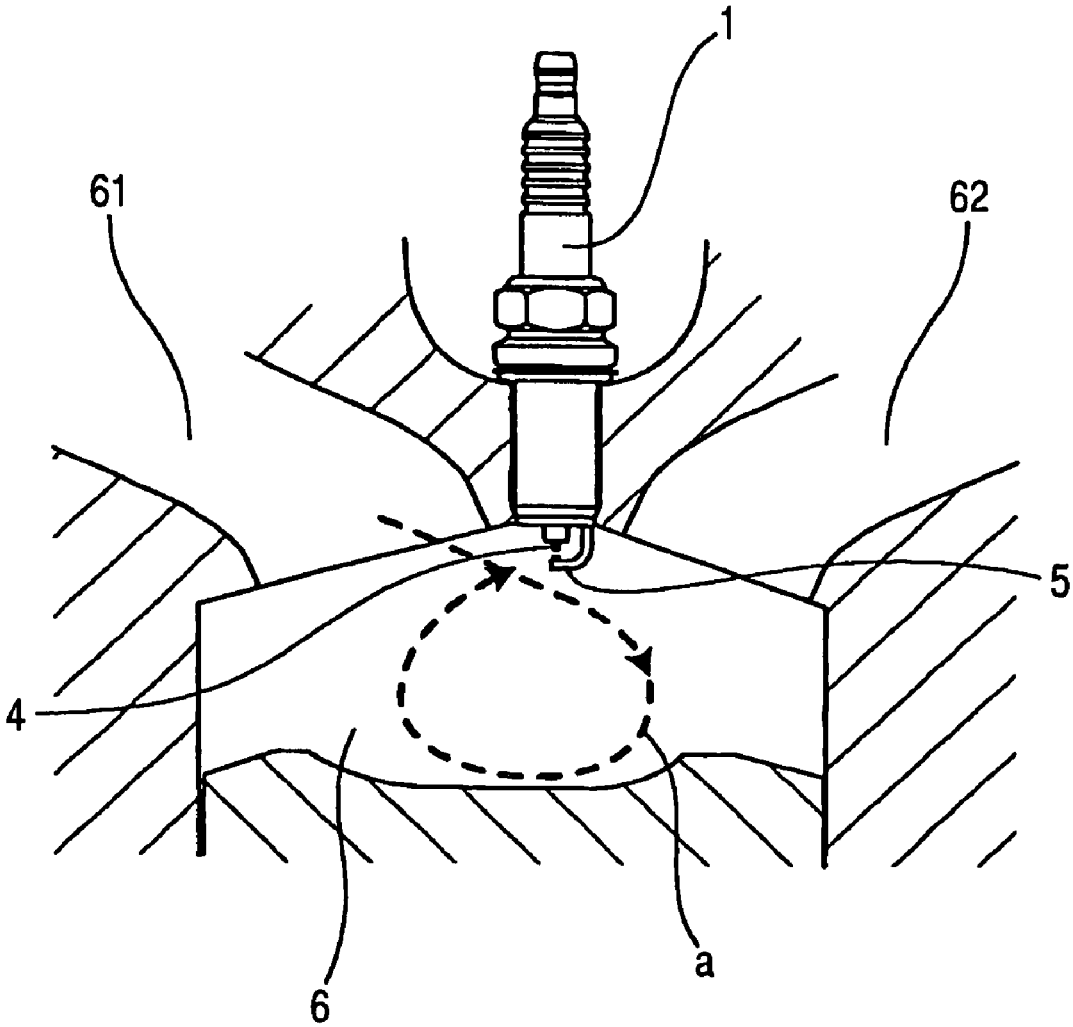
FIG. 3 is a partially sectional view which illustrates an internal combustion engine in which the spark plug of FIG. 1 is installed.

Referring to the drawings, wherein like reference numbers refer to like parts in several views, particularly to FIGS. 1 to 3, there is shown a spark plug 1 which may be used in internal combustion gasoline engines for automotive vehicles, cogeneration systems, or gas feed pumps.

The spark plug 1, as illustrated in FIG. 1, includes a cylindrical metal housing or shell 2, a porcelain insulator 3, a center electrode 4, and a ground electrode 5. The metal shell 2 is made of a hollow metallic cylinder and has cut therein a thread 21 for mounting the spark plug 1 in an engine block (not shown). The porcelain insulator 3 is retained coaxially within the metal shell 2. The center electrode 4 is retained coaxially within the porcelain insulator 3. The ground electrode 5 is joined to the metal shell 2 to define a spark gap between itself and the top end of the center electrode 4.

The metal shell 2, as clearly illustrated in FIG. 2, has an annular inner bulged portion 22 formed on an inner wall thereof to define an inner shoulder. The porcelain insulator 3 has formed on an outer wall a tapered surface or shoulder 32 which is placed on the inner shoulder of the inner bulged portion 22 of the metal shell 2 to position the porcelain insulator 3 within the metal shell 2.

The porcelain insulator 3 also has an annular tapered shoulder 31 formed on a portion of the outer wall between the tapered shoulder 32 and the top end surface 23 of the metal shell 2.

The tapered shoulder 32 of the porcelain insulator 3 is placed on the inner shoulder defined by the inner bulged portion 22 of the metal shell 2 through an annular gasket 11 to create a hermetic seal therebetween which hermetically insulates inside the metal shell 2 from outside the tapered shoulder 32. The porcelain insulator 3 defines an air pocket 12 inside the metal shell 2 between the gasket 11 (i.e., the tapered shoulder 32) and the top end surface 23 of the metal shell 2.

The tapered shoulder 31 of the porcelain insulator 3 is located slightly inside an entrance of the pocket 12 or the top end surface 23 of the metal shell 2. For instance, the tapered shoulder 31 lies deep inside the metal shell 2 zero (0) to five (5) mm away from the top end surface 23.

Referring back to FIG. 1, the ground electrode 5 has an L-shaped length made up of an upright portion 51 and a horizontal portion 52. The upright portion 51 extends vertically from the top end surface 23 of the metal shell 2 in parallel to the length (i.e. the axis) of the spark plug 1. The horizontal portion 52 continues from the upright portion 51 at right angles and has a top facing the top of the center electrode 4. The horizontal portion 52 has a noble metal chip 53 joined to an inside surface thereof facing the center electrode 4. Similarly, the center electrode 4 has joined to the top thereof a noble metal chip 43 which defines the spark gap between itself and the noble metal chip 53 of the ground electrode 5.

The spark plug 1 is, as illustrated in FIG. 3, installed in an internal combustion engine with the top exposed inside a combustion chamber 6. Specifically, the spark plug 1 is secured to the head of the engine through the threads 21 of the metal shell 2. The engine head has an intake port 61 through which an air-fuel mixture is sucked and an exhaust port 62 from which the exhaust gas is emitted. Upon charging of the air-fuel mixture into the combustion chamber 6 through the intake port 61, a vortex stream of the mixture, as indicated by a broken arrow a, will be created which hits the side of the top of the spark plug 1 from an oblique direction within the combustion chamber 6. The tapered shoulder 31 of the porcelain insulator 3 functions as a stream reflector to reflect or orient, as illustrated in FIG. 2, an oncoming portion of the vortex stream outside the pocket 12, thereby greatly decreasing the amount of the air-fuel mixture entering the pocket 12 near the top end 230 of the metal shell 2. This minimizes the possibility that the flame, as produced near the spark gap, will be carried by the stream of the air-fuel mixture into the pocket 12 so that it is extinguished, thus ensuring the ability of the spark plug 1 to ignite the mixture.

Figure 4:
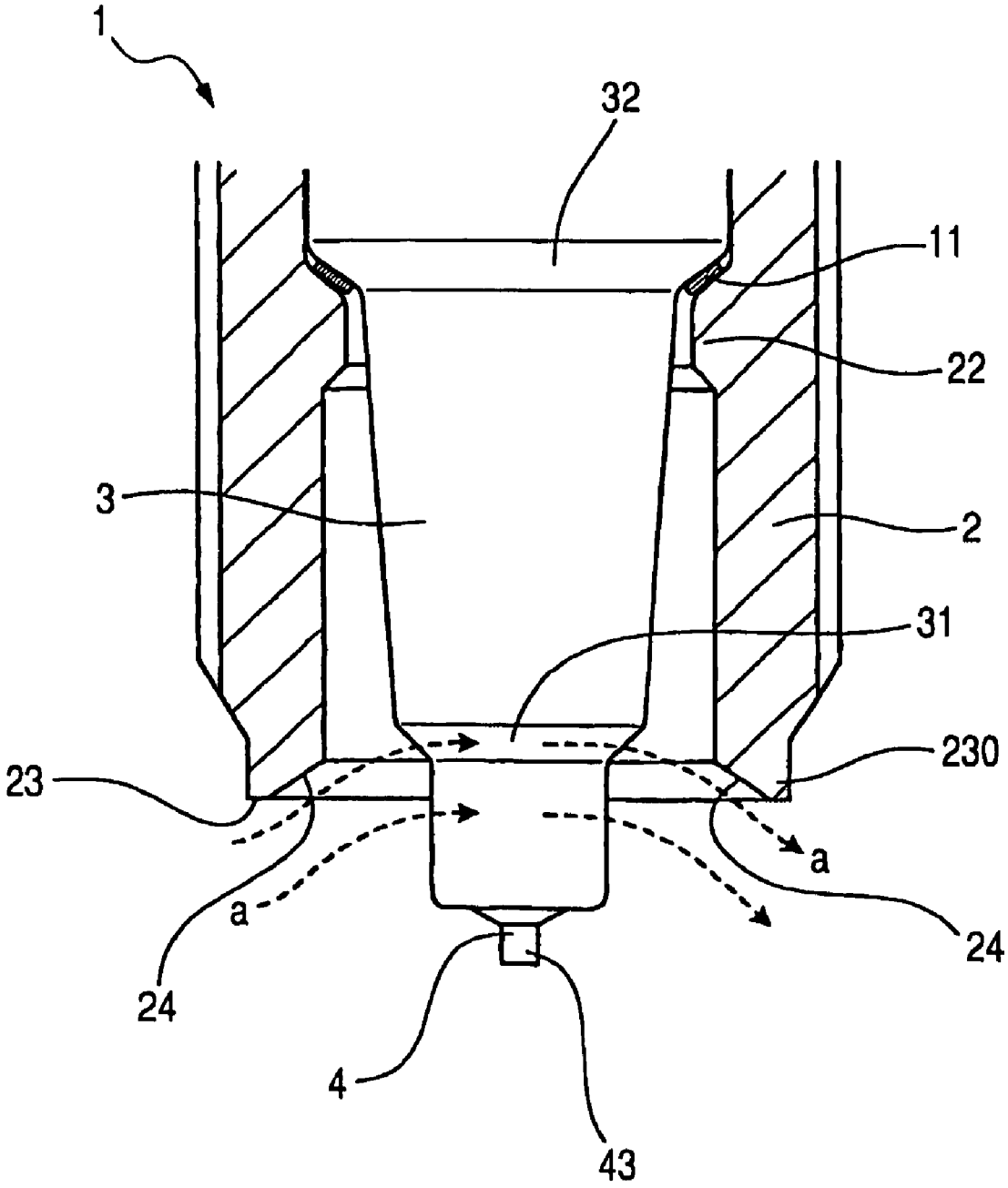
FIG. 4 is a partially enlarged longitudinal sectional view which illustrates a top end portion of a spark plug according to the second embodiment of the invention.
Figure 5:
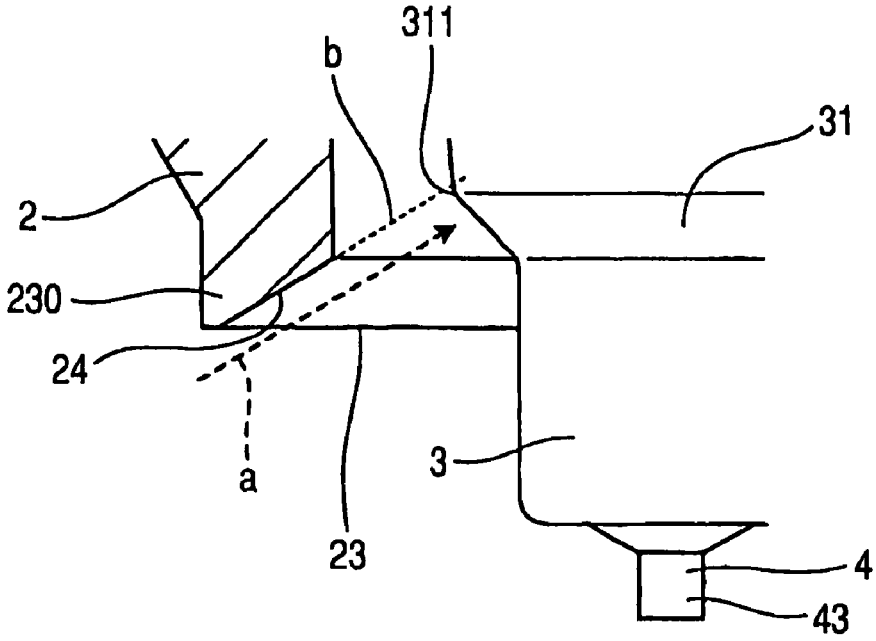
FIG. 5 is a partially enlarged sectional view which illustrates top ends of a metal shell and a porcelain insulator of the spark plug of FIG. 4.
Figure 6:
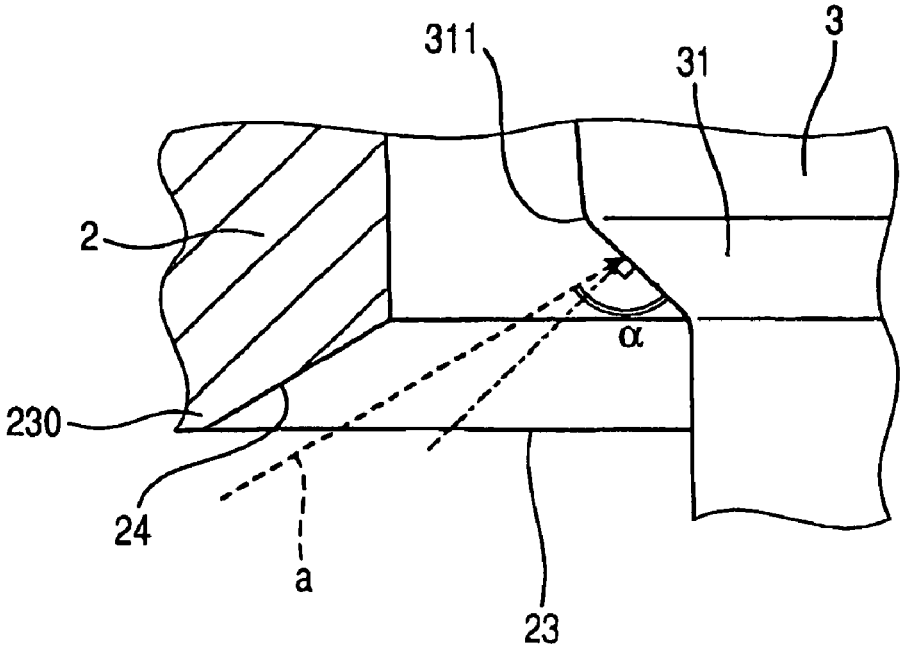
FIG. 6 is a partially enlarged sectional view which illustrates top ends of a metal shell and a porcelain insulator of the spark plug of FIG. 4.

FIGS. 4 to 6 illustrate the spark plug 1 according to the second embodiment of the invention. The same reference numbers, as employed in the first embodiment, will refer to the same parts, and explanation thereof in detail will be omitted here.

The metal shell 2 is equipped with a stream shaper formed on the top end 230 thereof. Specifically, the top end 230 of the metal shell 2 has an annular slant surface 24 which is formed on an inner peripheral wall thereof as the stream shaper so as to face inwardly of the metal shell 2. In other words, the slant surface 24 is so shaped as to define an inner diameter of a portion of the metal shell 2 near the top end surface 23 (i.e., the top end 230) which increases outward in an axial direction of the metal shell 2.

The slant surface 24 is preferably oriented so that a line b, as defined in FIG. 5 to extend along the slant surface 24 toward the longitudinal center line of the porcelain insulator 3, passes near a base edge of the tapered shoulder 31 of the porcelain insulator 3, that is, a boundary 311 between the tapered shoulder 31 and the major body of the porcelain insulator 3.

The slant surface 24 is also preferably oriented so that an angle $\alpha$ which a line a that represents an average of directions of the vortex stream of the air-fuel mixture flowing parallel to the slant surface 24 makes with the surface of the tapered shoulder 31 of the porcelain insulator 3 is an obtuse angle (i.e., 90° or more).

The slant surface 24 works as the stream shaper to shape or direct the vortex stream of the air-fuel mixture flowing to the pocket 12 toward the tapered surface 31, thereby facilitating the shaping of a stream of the air-fuel mixture, as indicated by broken arrows a in FIG. 4.

Figure 7:
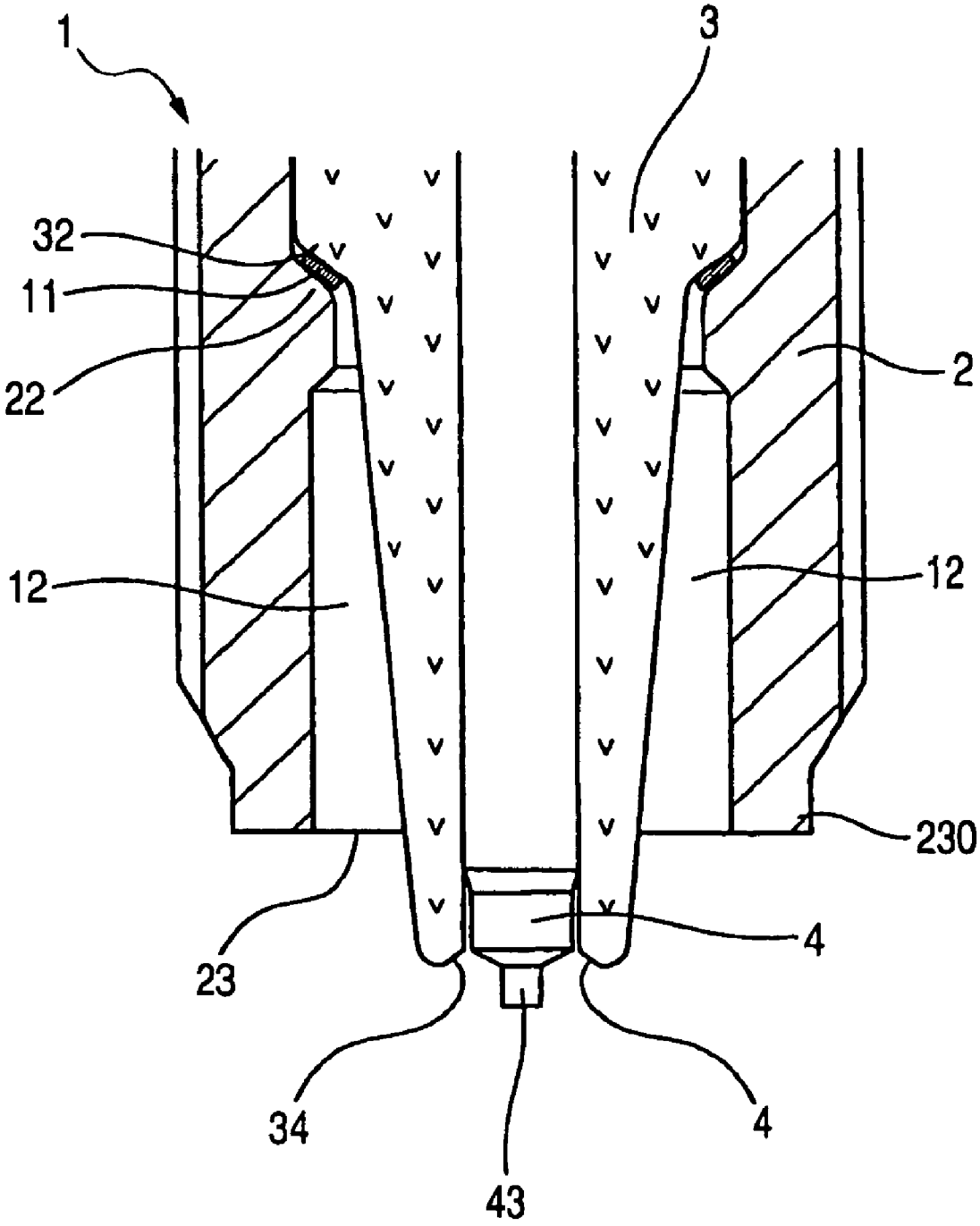
FIG. 7 is a partially enlarged longitudinal sectional view which illustrates a top end portion of a spark plug according to the third embodiment of the invention.
Figure 8:
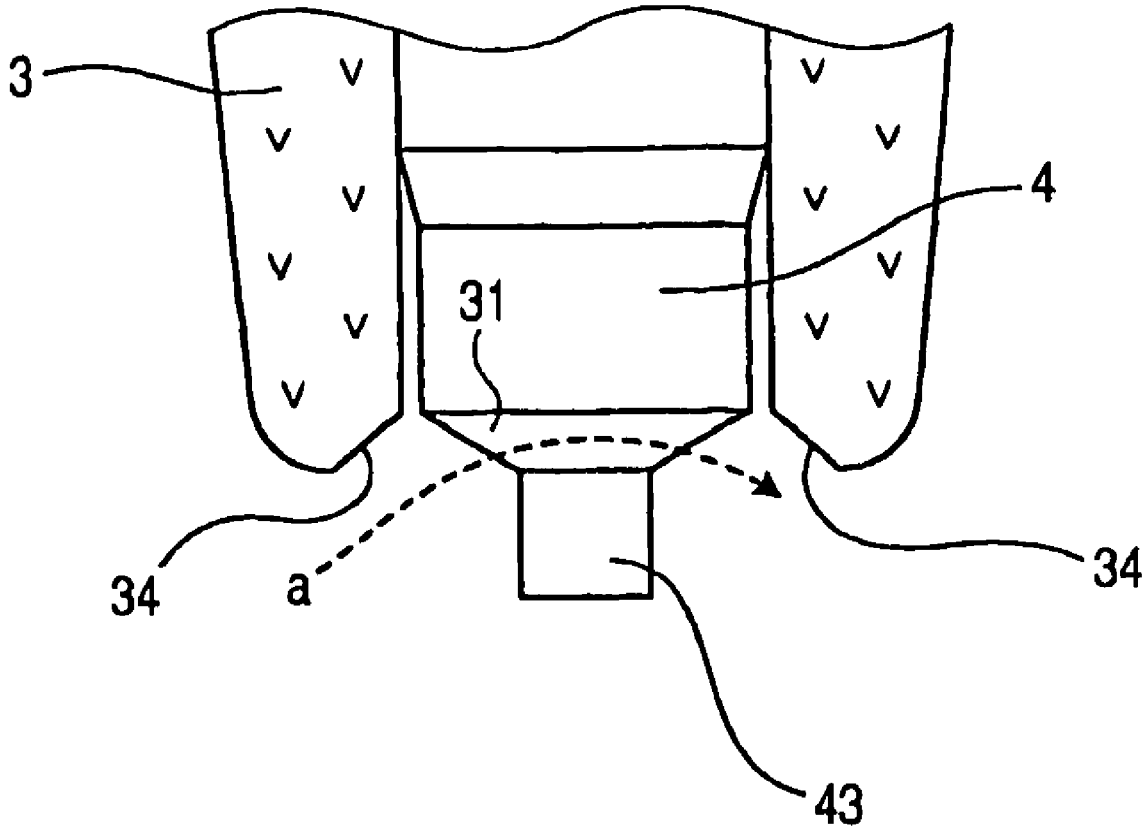
FIG. 8 is a partially enlarged sectional view which illustrates a top end of a porcelain insulator of the spark plug of FIG. 7.

FIGS. 7 and 8 illustrate the spark plug 1 according to the third embodiment of the invention.

The porcelain insulator 3 has an annular slant surface 34 formed on an inner peripheral wall thereof. The slant surface 34 faces inwardly of the porcelain insulator 3. The porcelain insulator 3 does not have the tapered surface 31, as illustrated in FIG. 2. Other arrangements are identical with those in the first embodiment, and explanation thereof in detail will be omitted here.

The slant surface 34 works as a stream shaper to shape the vortex stream of the air-fuel mixture flowing to the top of the porcelain insulator 3 into a stream of the air-fuel mixture, as indicated by the broken arrow a, along the slant surface 34 around the tapered surface 31. Specifically, the vortex stream of the air-fuel mixture flowing to the top of the porcelain insulator 3 is oriented as the stream, as indicated by the arrow a, away from the top of the porcelain insulator 3 (i.e., deep inside the combustion chamber). This minimizes the possibility that the flame, as produced near the spark gap, will be carried by the stream of the air-fuel mixture into the pocket 12 so that it is extinguished, thus ensuring the ability of the spark plug 1 to ignite the mixture.

Figure 9:
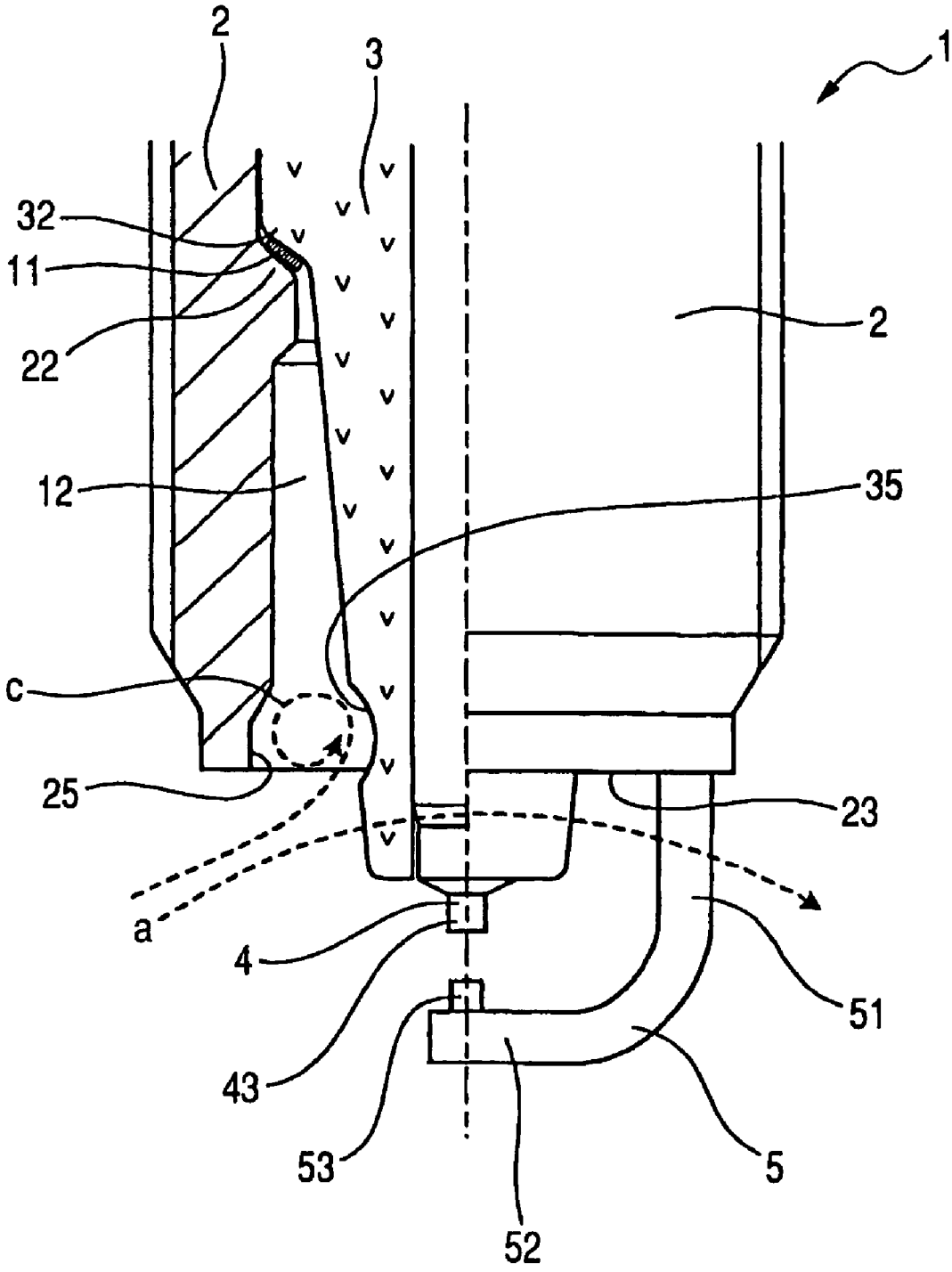
FIG. 9 is a partially enlarged longitudinal sectional view which shows a pocket formed between a metal shell and a porcelain insulator of a spark plug on an upstream side of a stream of air-fuel mixture according to the fourth embodiment of the invention.
Figure 10:
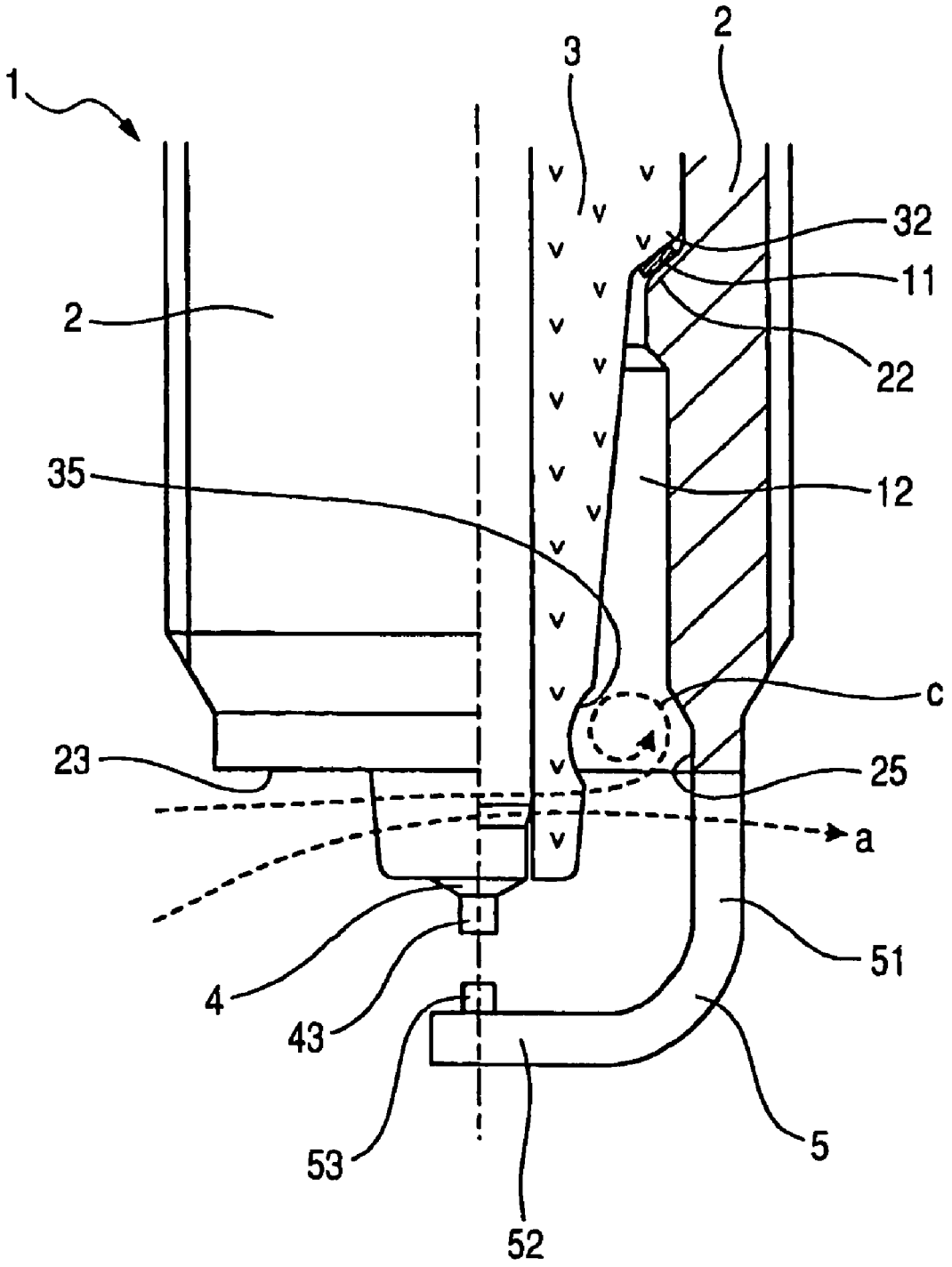
FIG. 10 is a partially enlarged longitudinal sectional view which a pocket formed between a metal shell and a porcelain insulator of the spark plug of FIG. 9 on a downstream side of the stream of air-fuel mixture.

FIGS. 9 and 10 illustrate the spark plug 1 according to the fourth embodiment of the invention.

The porcelain insulator 3 has formed in a peripheral portion thereof an annular recess or groove 35 which is located near the top end surface 23 of the metal shell 2, i.e., closer to the top end of the porcelain insulator 3 than the inner bulged portion 22 of the metal shell 2. The annular groove 35 is of an arc-shape in cross section and extends over the whole of circumference of the porcelain insulator 3.

The metal shell 2 has formed in an inner wall thereof closer to the top end surface 23 an annular recess or groove 25 facing the annular groove 35 of the porcelain insulator 3 to define an annular air chamber therebetween which is wider in a direction perpendicular to the length of the spark plug 1 (i.e., the metal shell 2) than a portion of the pocket 12 closer to the inner bulged portion 22.

The annular groove 35 of the porcelain insulator 3 works a stream shaper to shape a flow of the air-fuel mixture having entered the pocket 12 defined between the porcelain insulator 3 and the metal shell 2 into a vortex stream of the air-fuel mixture, as indicated by a broken arrow c, within the entrance of the pocket 12, thereby decreasing the amount of the air-fuel mixture flowing inside the pocket 12. Particularly, a vortex stream of the air-fuel mixture, as indicated by the arrow c in FIG. 10, created in a portion of the annular groove 35 located downstream of the spark gap functions as a stream stopper to stop the air-fuel mixture from flowing inside the pocket 12, thereby resulting in an increase in amount of the air-fuel mixture streaming outside the pocket 12, which minimizes the extinguishing of a flame of the air-fuel mixture.

Figure 11:
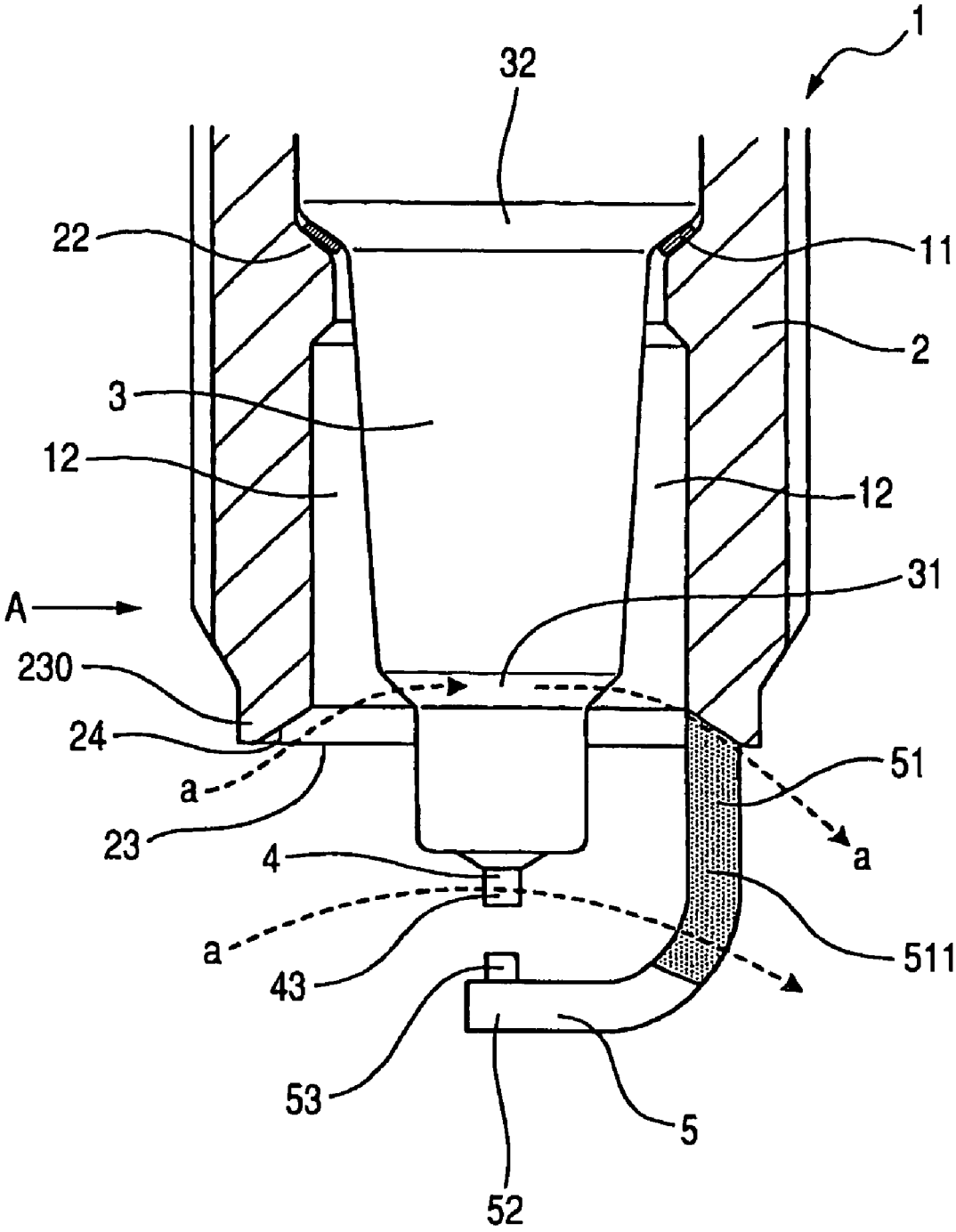
FIG. 11 is a partially enlarged longitudinal sectional view which illustrates a top end portion of a spark plug according to the fifth embodiment of the invention.
Figure 12:
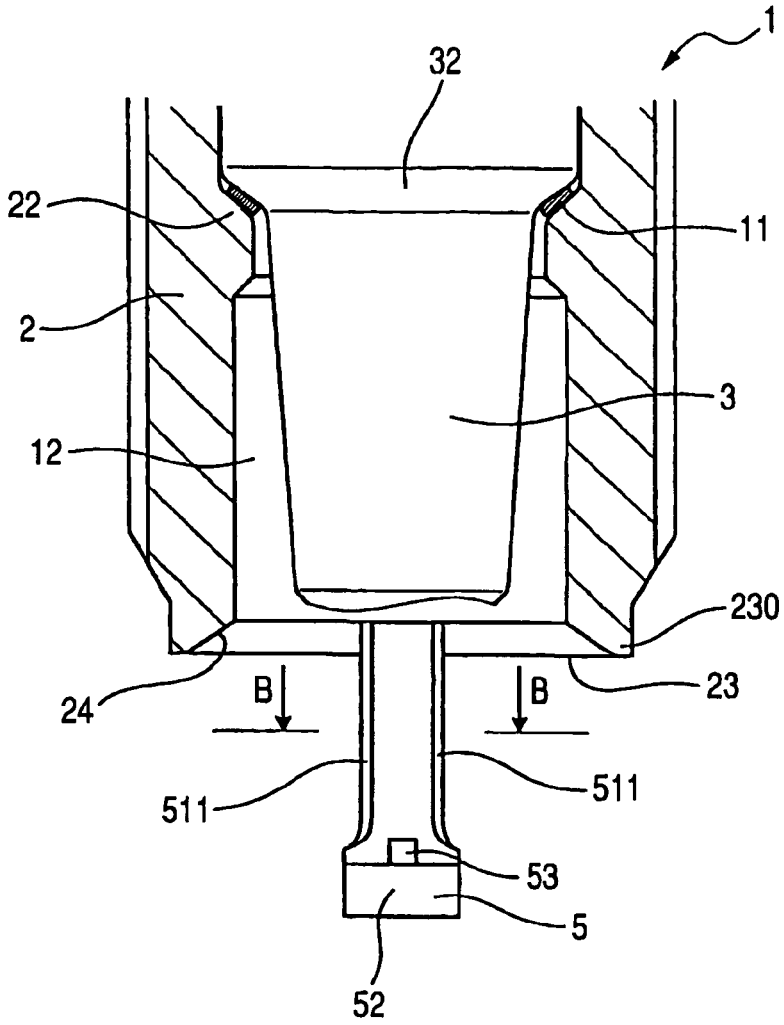
FIG. 12 is a partially enlarged longitudinal sectional view, as viewed from an arrow A in FIG. 11, in which a top portion of a porcelain insulator is omitted for the sake of ease of visibility.
Figure 13:
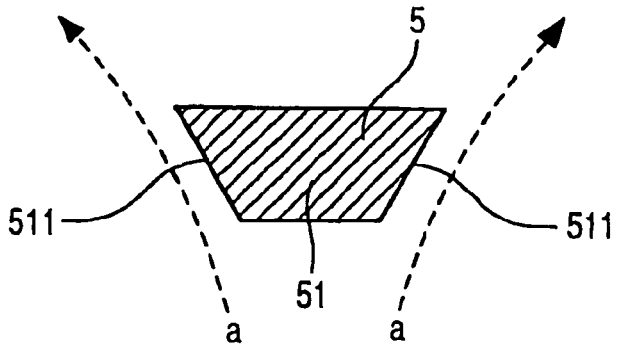
FIG. 13 is a traverse sectional view which shows a ground electrode of the spark plug, as taken along the line B-B in FIG. 12.

FIGS. 11 to 13 illustrate the spark plug 1 according to the fifth embodiment of the invention which is a modification of the structure in the second embodiment, as illustrated in FIGS. 4 to 6.

The upright portion 51 of the ground electrode 5 is, as can be seen from FIG. 12, shaped to have a narrow width section with side walls 511 which are chambered so that they taper inwardly. The narrow width section is smaller in width than the horizontal portion 52 and may be made by machining the sides of the upright portion 51. The illustration of FIG. 12 is viewed from an arrow A in FIG. 11 and omits the top end of the porcelain insulator 3 and the center electrode 4 for the sake of ease of visibility.

The spark plug 1 is so designed that the upright portion 51 of the ground electrode 5 is located downstream of the center axis of the spark plug 1 in a direction of a vortex stream of the air-fuel mixture in the combustion chamber of the engine. The side walls 511 are preferably formed over the whole of the upright portion 51.

The side walls 511 are, as can be seen from FIG. 13, shaped to taper upstream of the vortex stream of the air-fuel mixture passing through the spark plug 1 in the combustion chamber. Specifically, the narrow width section of the upright portion 51 has a trapezoidal transverse cross section whose width increases in the downstream direction of the vortex stream of the air-fuel mixture.

The tapered side walls 511 define mixture flow paths which facilitate the passage of the air-fuel mixture flowing from the left side, as viewed in FIG. 11, to the right side through the upright portion 51 of the ground electrode 5. Specifically, the tapered side walls 511 serve to minimize the disturbance of the stream of the air-fuel mixture which has flowed around the top of the porcelain insulator 3 and is going to pass the upright portion 51 of the ground electrode 5, thereby facilitating the ease of formation of streams of the air-fuel mixture, as indicated by broken arrows a in FIG. 11, oriented perpendicular to the axis of the spark plug 1 near the top end 230 of the metal shell 2 to minimize the amount of the air-fuel mixture flowing into the pocket 12. This minimizes the possibility that the flame, as produced near the spark gap, will be carried by the vortex stream of the air-fuel mixture into the pocket 12 so that it is extinguished, thus ensuring the ability of the spark plug 1 to ignite the mixture.

The upright portion 51 of the ground electrode 5 is, as described above in FIG. 13, shaped to have the tapered side walls 511, thereby minimizing the disturbance of the vortex stream of the air-fuel mixture which is going to pass the upright portion 51 without sacrificing the mechanical strength of the upright portion 51.

Figure 14:
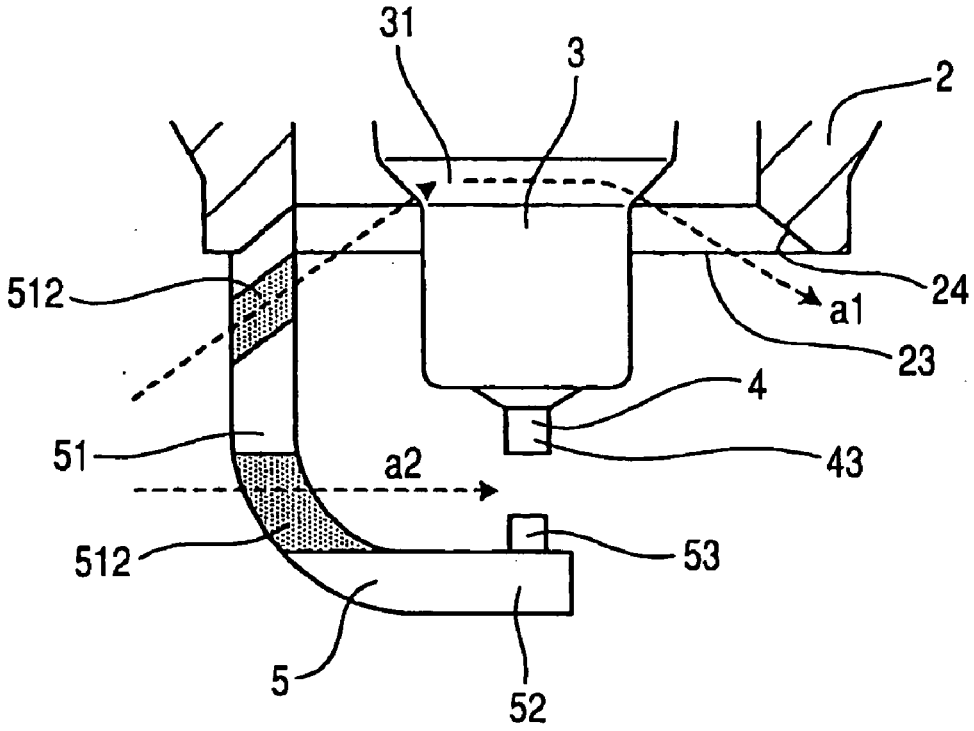
FIG. 14 is a partially enlarged longitudinal sectional view which illustrates a top end portion of a spark plug according to the sixth embodiment of the invention.
Figure 15:
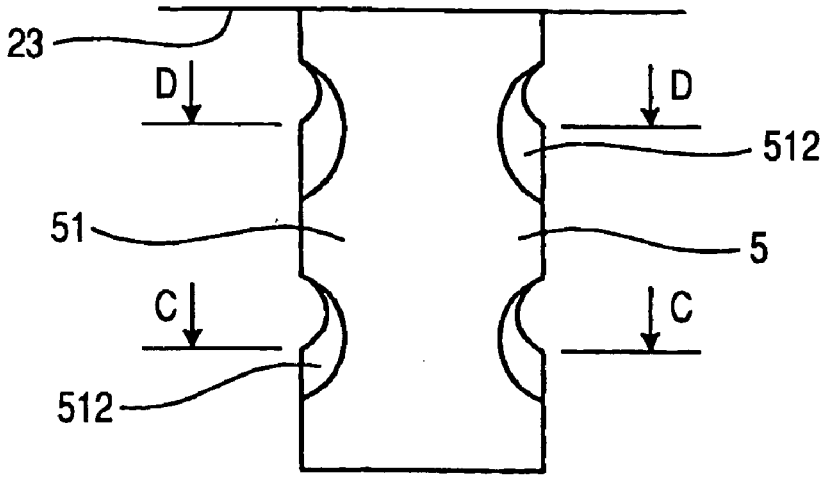
FIG. 15 is a side view which illustrates an upright portion of a ground electrode of the spark plug of FIG. 14, as viewed from the outside of the spark plug.
Figure 16:
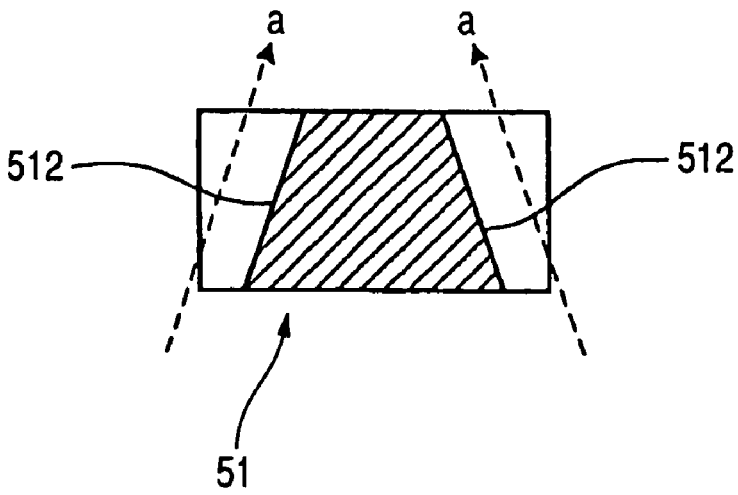
FIG. 16 is a sectional view, as taken along the line C-C or D-D in FIG. 15.

FIGS. 14 to 16 illustrate the spark plug 1 according to the sixth embodiment of the invention which is a modification of the one in the fifth embodiment illustrated in FIGS. 11 to 13 and designed to shape streams of the air-fuel mixture passing through the spark gap and the tapered shoulder 31 separately.

The upright portion 51 of the ground electrode 5 is shaped to have two discrete narrow width sections defined by two pairs of grooves 512. Two of the grooves 512 (will also be referred to as first grooves below) are located closer to the top end surface 23 of the metal shell 1, while the others (will also be referred to as second grooves below) are located closer to the horizontal portion 52. Each of the first and second grooves 512 may be made by machining one of side walls of the upright portion 51 to have an U-shape in cross section, as can be seen in FIG. 15.

Each of the first grooves 512 is so geometrically shaped as to direct a vortex stream of the air-fuel mixture having come near the top end surface 23 of the metal shell 2, as indicated by a broken arrow a1 in FIG. 14, to the tapered shoulder 31 of the porcelain insulator 3. The first grooves 512 have a constant width and define mixture flow paths which extend substantially parallel to the slant surface 24 of the metal shell 2, as viewed vertically of the spark plug 1, in other words, which are oriented toward the tapered shoulder 31 of the porcelain insulator 3. Each of the second grooves 512 is so geometrically shaped as to direct a vortex stream of the air-fuel mixture having come near a bend of the ground electrode 5, as indicated by a broken arrow a2 in FIG. 14, toward the spark gap.

Specifically, the second grooves 512 are shaped to define mixture flow paths extending horizontally, i.e., perpendicular to the length of the porcelain insulator 3 (i.e. the spark plug 1) through the spark gap.

Other arrangements are identical with those in the second embodiment, and explanation thereof in detail will be omitted here.

The spark plug 1 of this embodiment is so designed, as illustrated in FIG. 14, that the upright portion 51 of the ground electrode 5 is located upstream of the center axis of the spark plug 1 in a direction of the vortex stream of the air-fuel mixture in the combustion chamber of the engine. The first grooves 512 closer to the metal shell 2 work to focus the stream of the air-fuel mixture having come thereto on the tapered shoulder 31 of the porcelain insulator 3. After hitting the tapered shoulder 31, the stream of the air-fuel mixture is directed diagonally to the top of the metal shell 2.

The second grooves 512 closer to the horizontal portion 52 of the ground electrode 5 work to focus the stream of the air-fuel mixture having come thereto onto the spark gap to push the flame, as produced in the spark gap, out of the side of the spark gap laterally, thereby avoiding the entry of the flame into the pocket 12 to ensure the stability of ignition of the air-fuel mixture in the combustion chamber.

The spark plug 1 of this embodiment may alternatively be designed to place the upright portion 51 of the ground electrode 5 downstream of the center axis of the spark plug 1 in the direction of the vortex stream of the air-fuel mixture in the combustion chamber. In this case, the ground electrode 5 works in substantially the same way as in the second embodiment.

Figure 17:
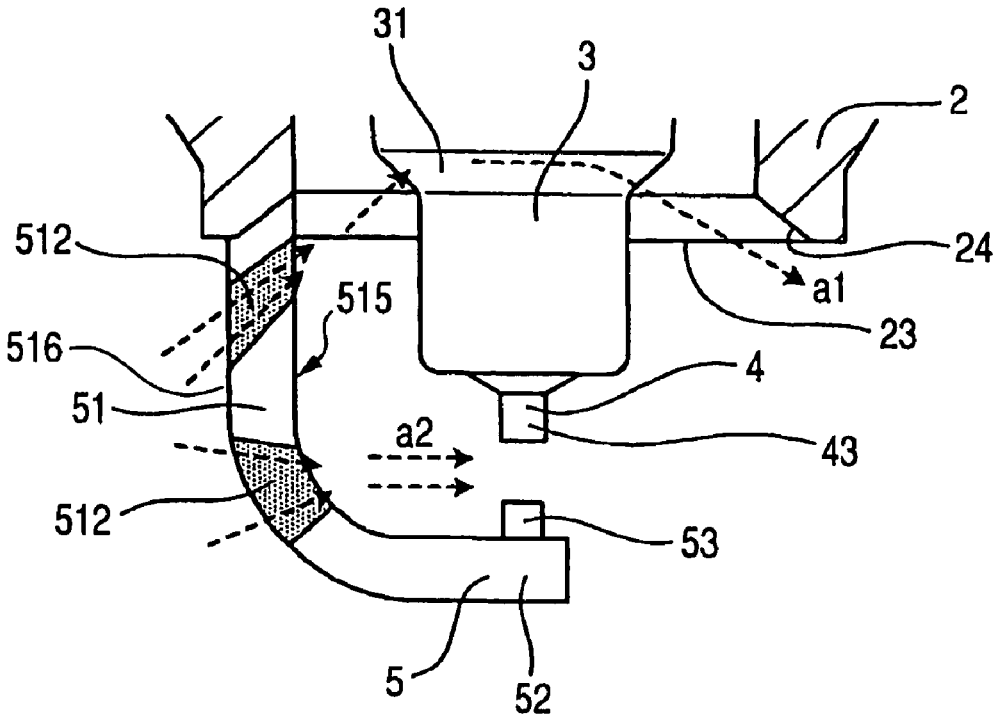
FIG. 17 is a partially enlarged longitudinal sectional view which illustrates a modification of the top end portion of the spark plug of FIG. 14.

FIG. 17 illustrates a modification of the ground electrode 5 in FIGS. 14 to 16. Specifically, each of the grooves 512 is so shaped that an inlet of the mixture flow path is greater in size than an outlet thereof. In other words, an open area of the outlet of the mixture flow path in an inner surface 515 of the upright portion 51 is greater than that of the inlet of the mixture flow path in an outer surface 516 of the upright portion 51.

The spark plug 1 of this embodiment is so designed that the upright portion 51 of the ground electrode 5 is located upstream of the center axis of the spark plug 1 in the direction of the vortex stream of the air-fuel mixture in the combustion chamber of the engine. Each of the grooves 512 works to increase the velocity of a stream of the air-fuel mixture passing through the mixture flow path defined thereby. Specifically, the stream of the air-fuel mixture flowing out of the first grooves 512 closer to the metal shell 2 traverses the length of the spark plug 1 near the top end surface of the metal shell 2 at a high speed, thereby enhancing the avoidance of entry of the flame into the pocket 12 to ensure the stability of ignition of the air-fuel mixture in the combustion chamber. Similarly, the stream of the air-fuel mixture flowing out of the second grooves 512 closer to the horizontal portion 52 of the ground electrode 5 pass through the spark gap at a high speed to push the flame, as produced in the spark gap, out of the side of the spark gap laterally, thereby enhance the avoidance of entry of the flame into the pocket 12.

Figure 18:
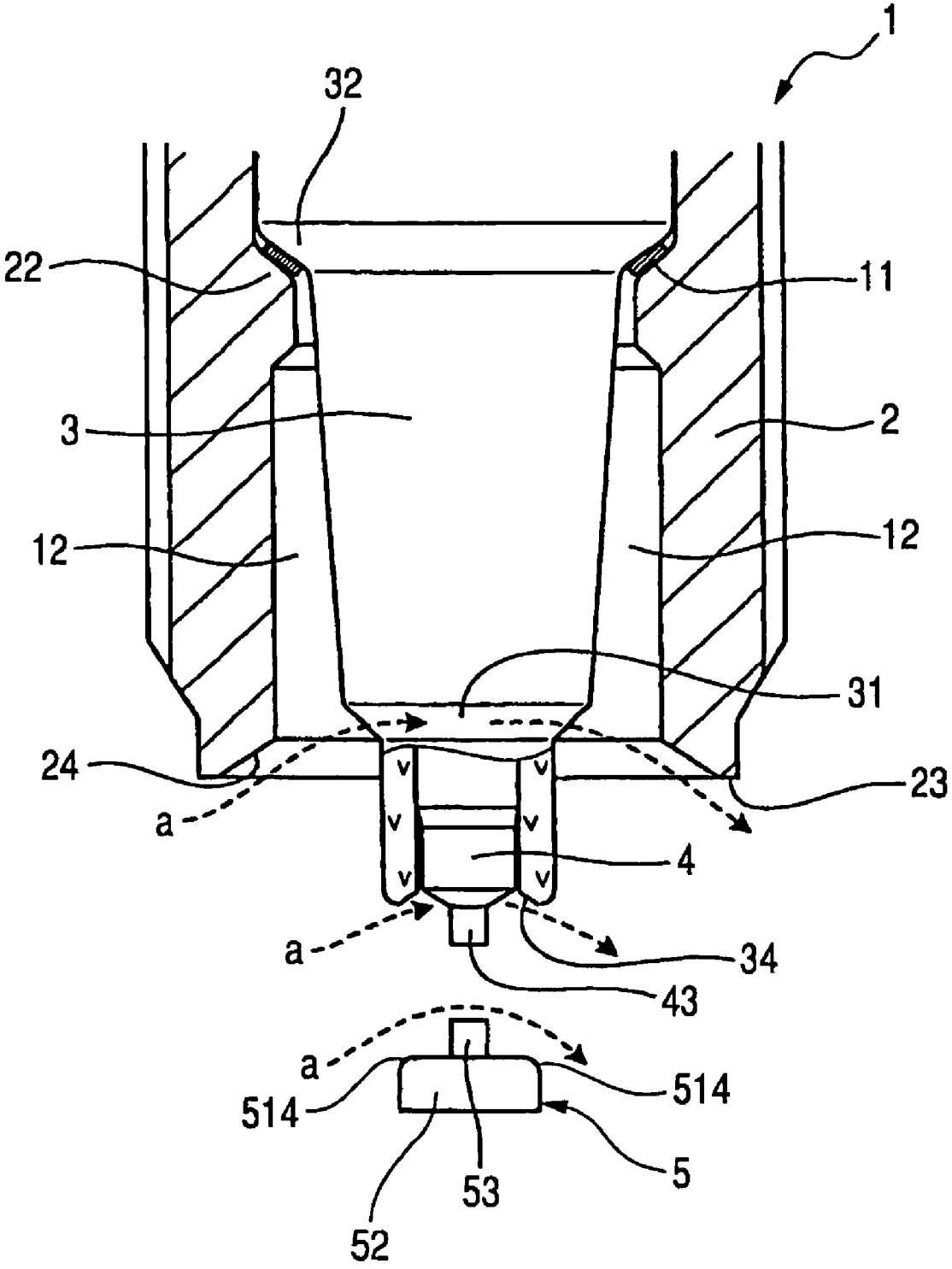
FIG. 18 is a partially enlarged longitudinal sectional view which illustrates a top end portion of a spark plug according to the seventh embodiment of the invention.

FIG. 18 illustrates the spark plug 1 according to the seventh embodiment of the invention which is a combination of the structures of the second and third embodiments.

Specifically, the porcelain insulator 3 has the tapered shoulder 31 and the annular slant surface 34. The top end 230 of the metal shell 2 has the annular slant surface 24 formed on the inner peripheral wall thereof.

The horizontal portion 52 of the ground electrode 5 has inner chamfered corners 514. The corners 514 are rounded, but may alternatively be so shaped as to taper straight toward the top of the center electrode 4.

Other arrangements are identical with those in the first embodiment, and explanation thereof in detail will be omitted here.

A vortex stream of the air-fuel mixture having come near the top end surface 23 is oriented, as indicated by an uppermost one of the broken arrows a, to flow along the slant surface 24 and the tapered shoulder 31 without entering the pocket 12. A vortex stream of the air-fuel mixture having come near the top of the porcelain insulator 3 is oriented, as indicated by a middle one of the broken arrows a, to flow along the slant surface 34 of the porcelain insulator 3 diagonally downward of the spark plug 1. Further, a vortex stream of the air-fuel mixture having come near the spark gap is oriented, as indicated a lowermost one of the broken arrows a, to flow along the chamfered corners 514 across the noble metal chip 53 so that it is directed diagonally downward of the spark plug 1.

The spark plug 1 may also be designed to have a combination of two or more of the structures in the first to seventh embodiments to enhance the shaping of the vortex stream of the air-fuel mixture, as produced in the combustion chamber of the engine, for ensuring the stability of ignition of the air-fuel mixture.

For instance, the spark plug 1 of the third embodiment, as illustrated in FIGS. 7 and 8, may be designed to have the porcelain insulator 3 with the annular groove 35 and/or the annular groove 24 of the fourth embodiment, as illustrated in FIG. 9. This structure may also be designed to have the ground electrode 5 in the fifth embodiment, as illustrated in FIGS. 11 to 13, or in the sixth embodiment, as illustrated in FIGS. 14 to 17.

The spark plug 1 of the third embodiment, as illustrated in FIGS. 7 and 8, or the fourth embodiment, as illustrated in FIG. 9, may also be designed to have the ground electrode 5 in the fifth embodiment, as illustrated in FIGS. 11 to 13, or in the sixth embodiment, as illustrated in FIGS. 14 to 17.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug for an internal combustion engine comprising:

a hollow cylindrical metal shell with an open top end, said metal shell having an annular inner shoulder formed on an inner peripheral wall thereof;

a porcelain insulator having a length, said porcelain insulator including a first outer shoulder formed on an outer peripheral wall thereof, said porcelain insulator being positioned within said metal shell in abutment of the first outer shoulder with the inner shoulder of said metal shell;

a center electrode disposed in said porcelain insulator;

a ground electrode joined to said metal shell to define a spark gap between itself and a top end of said center electrode; and a second outer shoulder formed on a portion of the outer peripheral wall of said porcelain insulator which is located between a top end of said porcelain insulator and the first outer shoulder of said porcelain insulator, said second outer shoulder being closer to the first outer shoulder than the open top end of said metal shell in a lengthwise direction of said porcelain insulator, said second outer shoulder tapering toward the top end of said porcelain insulator, wherein said metal shell has a slant peripheral surface formed on the open top end thereof, the slant peripheral surface facing inwardly of said metal shell so as to define an inner diameter of said metal shell increasing outward in an axial direction of said metal shell, wherein the slant peripheral surface is oriented so that a line, defined to extend along the slant peripheral surface toward a longitudinal center line of the porcelain insulator, passes near a boundary between the second outer shoulder of the porcelain insulator and a major body of the porcelain insulator, and wherein the slant peripheral surface is oriented so that an angle that a line, defined to represent an average of directions of a vortex stream of an air-fuel mixture flowing parallel to the slant peripheral surface, makes with a surface of the second outer shoulder of the porcelain insulator is an obtuse angle.

2. A spark plug as set forth in claim 1, wherein said porcelain insulator has a slant peripheral surface formed on the top end thereof, said slant peripheral surface facing inwardly of said porcelain insulator so as to define an inner diameter of said porcelain insulator increasing outward in an axial direction of said porcelain insulator.

3. A spark plug as set forth in claim 1, wherein said ground electrode includes an upright portion extending from said metal shell toward a top end of the spark plug in an axial direction of the spark plug, the upright portion having a narrow width section.

4. A spark plug as set forth in claim 1, wherein said ground electrode includes a portion with a chamfered corner which faces the top end of said center electrode.

* * * * *